US005099801A

United States Patent [19]

Scholl et al.

[11] Patent Number: 5,099,801

[45] Date of Patent: Mar. 31, 1992

[54] PROCESS FOR OPERATING A COAL-BASED FLUIDIZED BED COMBUSTOR AND FLUIDIZED BED COMBUSTOR

[75] Inventors: Gerhard Scholl, Spiesen-Elversberg; Hans-Karl Petzel, Scheidt; Lothar Stadie, Hochstadt, all of Fed. Rep. of Germany

[73] Assignees: Saarbergwerke Aktiengesellschaft, Saarbrucken; Siemens Aktiengesellschaft, Munich, both of Fed. Rep. of Germany

[21] Appl. No.: 602,306

[22] PCT Filed: Mar. 30, 1990

[86] PCT No.: PCT/DE90/00254

§ 371 Date: Dec. 12, 1990

§ 102(e) Date: Dec. 12, 1990

[87] PCT Pub. No.: WO90/12246

PCT Pub. Date: Oct. 18, 1990

[30] Foreign Application Priority Data

Mar. 30, 1989 [DE] Fed. Rep. of Germany ..... 3910271

[51] Int. Cl.[5] ..... B09B 3/00; F22B 1/00

[52] U.S. Cl. ..... 122/4 D; 110/245; 110/347; 165/104.16

[58] Field of Search ..... 110/245, 346, 263, 347; 122/4 D; 165/104.16

[56] References Cited

U.S. PATENT DOCUMENTS

| | | | |
|---|---|---|---|
| 4,111,158 | 9/1978 | Reh et al. | 122/4 D |
| 4,227,488 | 10/1980 | Stewart et al. | 122/4 D |
| 4,421,036 | 12/1983 | Brannstrom et al. | 110/245 X |
| 4,505,209 | 3/1985 | Strohmeyer, Jr. | 110/245 |
| 4,776,288 | 10/1988 | Beisswenger et al. . | |
| 4,815,418 | 3/1989 | Maeda et al. | 110/245 X |

FOREIGN PATENT DOCUMENTS

| | | |
|---|---|---|
| 0028458 | 5/1981 | European Pat. Off. . |
| 2929264 | 1/1981 | Fed. Rep. of Germany . |
| 1522601 | 8/1978 | United Kingdom . |
| 2007811 | 5/1979 | United Kingdom . |
| 2124101 | 2/1984 | United Kingdom . |

OTHER PUBLICATIONS

Kelly et al., "Industrial Application of Fluidized-Bed Cogeneration System", Chemical Engineering Process, 80:1, 35–40 (U.S.A. Jun. 1984).

*Primary Examiner*—Edward G. Favors

*Attorney, Agent, or Firm*—James Creighton Wray

[57] ABSTRACT

Some part (a) of the bed material is withdrawn continuously (9e, 10) from the lower region of the fluidized bed (20), cooled (11), screened (12, 13) on a belt (a') to obtain a particle size specific to the fluidized bed, and then recycled to the fluidized bed (15, 18).

10 Claims, 1 Drawing Sheet

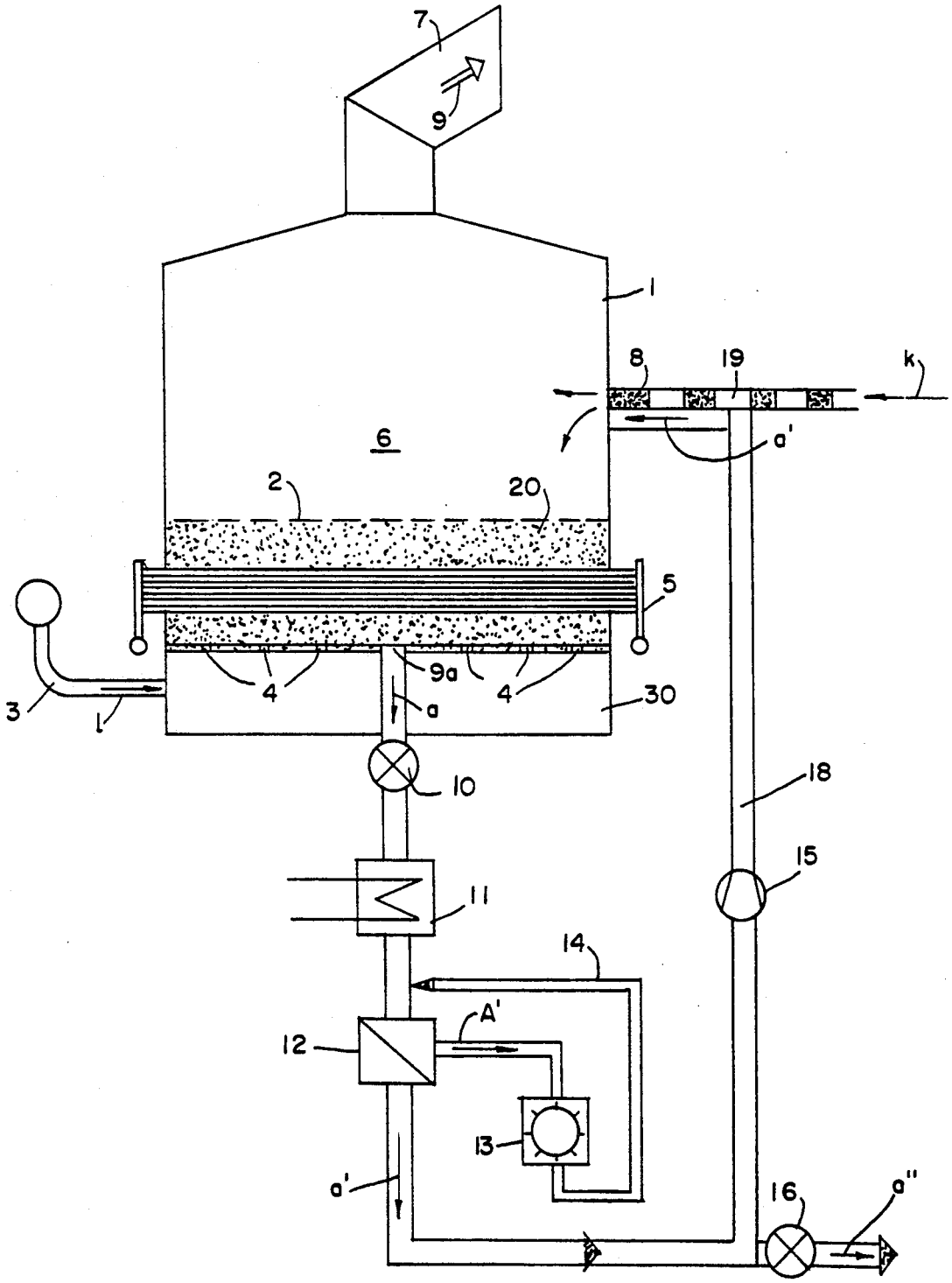
7
9
1
8
19
k
6
a'
2
20
5
3
l
4
9a
4
a
30
10
18
15
11
14
A'
12
13
a'
16
a''

PROCESS FOR OPERATING A COAL-BASED FLUIDIZED BED COMBUSTOR AND FLUIDIZED BED COMBUSTOR

BACKGROUND OF THE INVENTION

The invention relates to a process for operating a fluidized bed combustor on coal basis in which comminuted coal is fed into a fluidized bed and burned with the bedding material. The invention furthermore relates to a fluidized bed combustor with a conveyor to feed the coal and with a nozzle bottom on which a fluidized bed consisting of bedding material is positioned during operation.

According to the present state of technology, coal is burned in fluidized bed combustion systems for steam and/or electricity generation (Siemens-Energietechnik 2 (1980), Issue 7, pp. 231–235). This results in two significant advantages. First, the combustion in the fluidized bed occurs at relatively low temperatures so that in comparison with known combustions using dry or even wet ash relatively little nitrogen oxide is formed Second, the combustion in the fluidized bed places relatively low requirements on the used coal, i.e. even a relatively roughly ground coal with high ash content may be burned without problems. "Ash" here means the incombustible substances contained in the coal, such as sand, clay, salts, metal compounds, etc.

When operating a fluidized bed combustor, coal is used which is ground to a grain size specific to the fluidized bed. It is fed to the fluidized bed, i.e. in most cases via the free space located above the fluidized bed. It is then mixed homogeneously with the bedding material. This bedding material consists both of sand and ash particles which were added to the fluidized bed with the coal, and of migrating coal particles.

A disadvantage here is that, in particular in the case of discontinuous ash removal, the fine-particle bedding material in the fluidized bed is continuously reduced because of flue-dust removal with the flue gas. The rough grain content increases steadily and settles during longer operation on the nozzle bottom of the fluidized bed. This again results in the obstruction of individual nozzles which feed the carrier air. As a consequence, locally differing zones with little or no air throughput at all are generated, as well as zones with increased air throughput. This significantly impairs the temperature homogeneity of the fluidized bed which is required for the removal of the generated heat, e.g. via a heat exchange system. In addition, temperature streaks form above the areas with increased air throughput in the free space of the fluidized bed combustor. These are narrow, long-stretched structures which are above the softening point of the ash. This results in slagging of the free space, e.g. in the form of nests. These slaggings may make it necessary to take the fluidized bed combustor out of operation. It is therefore important to balance the temperature distribution as evenly as possible over the entire fluidized, bed so that no slag deposits may form.

SUMMARY OF THE INVENTION

The invention has the task of providing a process of the above described type which makes it possible to operate a coal-based fluidized bed combustor without problems even over a longer period. In addition, a fluidized bed combustor of the above described type shall be provided which will make it possible to avoid the formation of slag over a longer period.

According to the invention the first task is solved in that part of the bedding material is removed from the bottom region of the fluidized bed continuously or discontinuously, is then preferably cooled, subsequently processed to a predetermined maximum grain size which is specific to the fluidized bed, and is then recycled to the fluidized bed.

According to the invention the second task is solved by a system characterized by a) a removal mechanism for the removal of part of the bedding material which is located in the bottom region of the fluidized bed;
b) an ash cooler which cools the removed bedding material and which is preferably located behind the removal mechanism;
c) a mechanism for processing the bedding material to a preestablished maximum grain size specific to the fluidized bed;
d) an outlet for excess bedding material; and
e) conveyor means for the transport of the processed bedding material into the fluidized bed.

The invented suggestion attempts to no longer adjust the optimum grain size range of the bedding material of a fluidized bed combustor by way of grinding the added fresh coal, but rather to achieve this through (preferably continuous) processing of the bedding material.

The bedding material may be processed here simply by way of a screening mechanism which is adjusted to the necessary grain size range and which separates a fine grain and rough grain fraction in this way. In the process the rough grain fraction which does not pass the screening mechanism is ground in a comminution or, specifically, a grinding mechanism and is in comminuted form recycled to the screening mechanism. In place of screening, it is also possible to use wind sizing. The preestablished maximum grain size may then e.g. be 3 to 4 mm.

Since according to the invention the optimum fluidized bed grain size range is no longer adjusted by means of the added coal, it is only necessary to grind the transported coal fed to the fluidized bed to a relatively rough particle size. In addition to the savings in processing and grinding costs for the coal the use of rough-grained coal has the additional advantage that in comparison with the fine-ground coal the free surface of the added coal is overall rather small. When the coal is added into the free space above the fluidized bed, only a small part of the coal therefore evolves into gas already when it is added to this free space. As a result the temperature of the free space remains relatively low so that problems in respect to increased slag formation will no longer occur.

A further reduction in gas evolution of the fresh fuel (coal) in the free space above the fluidized bed may be achieved in that, according to a further development of the invention, the processed and recycled bedding material (ash) is not added into the fluidized bed separately from the fuel (coal) but is mixed with this fuel prior to this process. This increases the content of cold inert material (ash, sand, etc.) during the feeding of the coal and results during the fuel addition in a temperature reduction in the free space.

During the course of combustion the rough grain part of the coal slowly migrates to the nozzle bottom of the fluidized bed. It is removed here—as described—and is then processed. It is useful here that an amount of bedding material (i.e. mostly ash) is removed during each timw unit which is greater than the amount which is fed as rough grain by way of the coal to the fluidized bed. In this way a settling of the rough grain on the nozzle bottom of the fluidized bed may be avoided with certainty.

The outlet for the excess bedding material may principally be located on the nozzle bottom or in front of the screening mechanism. But it is preferred that the outlet for excess bedding material is located in the transport path behind the mechanism for the processing of the bedding material. This is advantageous when the material removed here is placed in intermediate storage in a hopper and is then further processed. In this case it is already processed for further processing in the fluidized bed.

Overall, the invention makes it possible to burn coals with varying calorific values without problems in a fluidized bed combustor and without great requirements on processing and grinding.

BRIEF DESCRIPTION OF THE DRAWING

The figure is a schematic representation of a fluidized bed combustor of the present invention.

DETAILED DESCRIPTION OF THE DRAWING

The invention and additional versions thereof are described in the following with the help of the example of a fluidized bed combustor shown schematically in the drawing.

The drawing shows a kettle 1 operated by fluidized bed combustion on coal basis which has a fluidized bed 20 whose top level is designated by arrow 2. The carrier air 1 for the fluidized bed 20 is fed through a pipe 3 into an air box 30. From there it is by way of distributor nozzles 4 which are located in the nozzle bottom 9 fed into the bedding material of the fluidized bed 20. In this case the bed 20 consists of a mixture of coal particles and particles of coal ash, i.e. of coal and burned and unburned residues. The heat generated in the fluidized bed 20 is here removed via a heat exchange system 5 which is located directly above the nozzle bottom 9, e.g. with the help of air or water as a heat exchange medium. The heat may be used for heating the working substances of a gas or steam turbine which is not shown here. During operation the fluidized bed 20 has e.g. a temperature of 850° C. It is important that during operation the temperature is balanced as best as possible over the entire fluidized bed 20 so that no slag which settles in the kettle 1 and/or flue gas outlet may form from ash and coal particles. The flue gases g from the combustor which contain fine dust or fine ash first pass a free space 6 which is located above the fluidized bed 20. They are then fed to mechanisms which separate dust and noxious substances (not shown) by means of an outlet 7, at e.g. 950° C. From there they are transferred to a heat exchanger (not shown), e.g. in a steam generator.

Comminuted, but relatively rough-grained (roughly ground), fresh coal k is added via a conveyor path 8 above the fluidized bed level 2 into the free space 6, e.g. with the help of a metering hopper or thrower (not shown). Alternatively, it could be added in the area of the fluidized bed 20, e.g. through direct firing or other known methods.

In the fluidized bed 20 the direct firing with air causes the described mixing of larger and smaller particles present. However, because of vertical migration and force of gravity the bottom region of the fluidized bed will contain mostly rougher particles.

The bedding material a which collects in the area of the nozzle bottom 9 of the fluidized bed 20 is removed by way of a removal mechanism which in this case is constructed in the form of an outlet opening 9a located in the nozzle bottom 9 and by means of an ash or cellular wheel sluice 10. For redundancy, several of such removal mechanisms 9a, 10 may be provided. It is preferred that the withdrawal is continuous. The removed bedding material a, essentially ash, is then cooled, e.g. through natural cooling as it is left to stand, or—as in this case—through forced cooling in an ash cooler 11.

The removed and then cooled bedding material a which includes all possible particle or grain sizes is then transferred to a mechanism 12,13 where it is processed to a preestablished maximum grain size which is specific to the fluidized bed. This preestablished maximum grain size which may be processed further may e.g. be 4 mm. Naturally, a different grain size may be determined. This depends on operating parameters which exist or are to be set. In this case the processing mechanism has a screening mechanism 12, a comminution mechanism 13, e.g. an ash breaker, and a transport pipe 14. The screening mechanism 12 separates a fine grain fraction a', in the example with a grain size below 4 mm, and a rough grain fraction A', in the example with a grain size above 4 mm. The rough grain fraction A' is transferred to the comminution mechanism 13. The output of the latter is connected via pipe 14 to the input of the screening mechanism 12. During the course of the processing the rough grain fraction A' which does not pass the screening mechanism 12 is removed, comminuted in the ash breaker 13 and then transferred back to the screening mechanism 12 via the pipe 14. It is preferred that the amount of bedding material a' which is removed and processed per time unit is greater than the amount of ash added with and contained in the coal k in this time unit.

The bedding material a' which was processed according to the required grain size is transported into the fluidized bed 20 by way of suitable transport means. In this case a conveyor unit 15 on a conveyor path 18 is used, e.g. a conveyor belt. Pneumatic transport is also possible. The bedding material a' is preferably mixed with the fresh coal k in a mixing chamber 19 in the conveyor path 8. The processed material a' is fed together with this coal k via a free space 6 into the fluidized bed 20. Naturally, the material a' may also—as in the drawing—be thrown onto the fluidized bed 20 separately from the coal k.

Excess material a'' is withdrawn from the system via an ash outlet or ash sluice 16 which is located behind the screening mechanism 12. This ash sluice 16 is preferably constructed adjustable; it is e.g. adjustable by means of a motor.

The withdrawal is performed in such a way—under consideration of ash content and transport of the coal k as well as the removal speed at the sluice 10—that the level 2 of the fluidized bed 20 is maintained at a constant level. The withdrawn material a'' is stored in a sand or ash hopper. It may possibly be recycled, i.e. be added to the coal k in the mixing chamber 19 at a later time. The ash sluice 16 may also be located at a different place, e.g. in front of the screening mechanism 12 for the removal of unprocessed bedding material a. In the shown position it has the advantage, however, that material a' with the correct maximum grain size is already provided for further processing at a later time.

The described processing ensures that the required grain size range 0 up to e.g. 4 mm for the bedding material is consistently approximately maintained within the fluidized bed 20. No major requirements exist for processing and grinding of the fresh coal k itself. A relatively rough-grained coal k may be used which results in the conservation of processing and grinding costs.

We claim:

1. Process for operating a coal-based fluidized bed combustor in which comminuted coal (k) is fed to a fluidized bed (20) and is burned together with the bedding material, characterized in that part of the bedding material from the bottom region of the fluidized bed (20) is withdrawn continuously or discontinuously, is then preferably cooled, then processed to a preestablished maximum grain size specific to the fluidized bed, and is then recycled back to the fluidized bed (20), further characterized in that the recycled bedding material (a') is mixed with the coal (k) prior to its addition to the fluidized bed (20).

2. Process according to claim 1, characterized in that the amount of bedding material (a') withdrawn and processed per time unit is greater than the amount of ash added with and contained in the coal k.

3. Process according to claim 2, characterized in that the withdrawn bedding material (a) is screened during processing so that a fine grain fraction (a') and a rough grain fraction (A') is generated whereby the rough grain section (A') has a grain size which is larger than the preestablished maximum grain size specific to the fluidized bed, and that the rough grain fraction (A') is comminuted and screened together with additional withdrawn bedding material (a).

4. Fluidized bed combustor with a conveyor path (8) for the transport of the coal (k) and a nozzle bottom (9) on which a fluidized bed is located which consists during operation of bedding material, characterized by a) a removal mechanism **(9*a* , 10) for the removal of part of the bedding material (a) which is located in the bottom region of the fluidized bed (20)**;

b) an ash cooler (11) which cools the removed bedding material (a) and which is preferably located behind the removal mechanism **(9*a*, 10)**;

c) a mechanism (12, 13) for processing the bedding material (a) to a preestablished maximum grain size specific to the fluidized bed;

d) an outlet (16) for excess bedding material (a or a'); and e) conveyor means (15,18) for the transport of the processed bedding material (a') into the fluidized bed (20), further characterized in that the mechanism (12,13) for the processing of the bedding material (a) includes a screening mechanism (12) which separates a fine grain fraction (a') and a rough grain fraction (A'), further characterized in that the screening mechanism (12) has a correlating comminuting mechanism (13) to which the rough grain fraction (A') separated by the screening mechanism (12) may be fed and whose output is connected to the input of the screening mechanism (12).

5. Fluidized bed combustor according to claim 4, characterized in that the conveyance means (15,18) include a conveyor belt (18).

6. Fluidized bed combustor according to claim 4, characterized in that a mixing chamber (19) is provided where the processed bedding material (a') may be mixed with the coal (k).

7. Fluidized bed combustor according to claim 4, characterized in that the outlet (16) for excess bedding material (a or a') is located in the transport path behind the mechanism (12,13) for the processing of the bedding material (a).

8. Fluidized bed combustor according to claim 4, characterized in that the removal mechanism **(9*a*,10) includes at least one cutlet opening (9*a*) which is located in a nozzle bottom (9)**.

9. Fluidized bed combustor according to claim 8, characterized in that a heat exchange system (5) is located above the nozzle bottom (9).

10. Fluidized bed combustor according to claim 4, characterized in that the preestablished maximum grain size specific to the fluidized bed is ca. 3 to 4 mm.

* * * * *